United States Patent [19]

Mitchell

[11] Patent Number: 4,998,298

[45] Date of Patent: Mar. 12, 1991

[54] KNEELING AID AND METHOD OF USE

[76] Inventor: Edgar D. Mitchell, P.O. Drawer C, Taos, N. Mex. 87571

[21] Appl. No.: 526,529

[22] Filed: May 21, 1990

Related U.S. Application Data

[62] Division of Ser. No. 294,688, Jan. 9, 1989, abandoned.

[51] Int. Cl.[5] ..... E03D 11/00

[52] U.S. Cl. ..... 4/254; 4/DIG. 8; 182/113

[58] Field of Search ..... 4/254, 661, DIG. 9; 297/183, 187; 182/113, 96

[56] References Cited

U.S. PATENT DOCUMENTS

| | | | |
|---|---|---|---|
| D. 201,796 | 8/1965 | Rolley | D6/349 |
| 830,103 | 9/1906 | Rundell | 182/230 |
| 1,529,498 | 3/1925 | Novak | 182/230 |
| 1,612,871 | 1/1927 | McCann | 297/187 |
| 2,083,605 | 6/1937 | Jertberg | 4/254 |
| 2,225,696 | 12/1940 | Holzderber | 182/230 |
| 2,237,909 | 4/1941 | Lund | 297/187 |
| 2,318,416 | 5/1943 | Peirce | 182/129 |
| 2,829,705 | 5/1958 | Godshalk et al. | 297/2 |
| 3,884,327 | 5/1975 | Zigman | 182/113 |
| 4,244,064 | 1/1981 | Parr | 4/254 |
| 4,394,049 | 7/1983 | Ward | 297/439 |
| 4,518,060 | 5/1985 | Natcheu | 182/230 |
| 4,534,072 | 8/1985 | Lipski | 4/254 |

*Primary Examiner*—Henry J. Recla
*Assistant Examiner*—Robert M. Fetsuga
*Attorney, Agent, or Firm*—Munson H. Lane, Jr.

[57] ABSTRACT

A portable kneeling aid for use by a human male while urinating into a conventional flush-type toilet bowl with upper rim from a kneeling position comprising a portable platform having a top surface and supporting structure secured to and beneath the top surface for supporting the top surface horizontally above a floor adjacent to the toilet bowl at a height which permits the male while kneeling with one knee upon the top surface to urinate into the toilet bowl from a level slightly above the rim of the toilet bowl, an upright standard secured to said platform and a hand grip secured to the top of said standard for supporting the male while kneeling onto the platform and while rising from a kneeling position on the platform to a standing position. A method of use for the kneeling aid includes the steps of kneeling onto the platform, urinating into the bowl and rising from the platform. The kneeling and rising steps are facilitated by the standard and handgrip.

1 Claim, 1 Drawing Sheet

KNEELING AID AND METHOD OF USE

This is a divisional of copending application Ser. No. 07/294,688 filed on Jan. 9, 1989 now abandoned.

FIELD OF THE INVENTION

The invention relates to a kneeling aid for use by a male while urinating into a toilet bowl from a kneeling position.

BACKGROUND OF THE INVENTION

The common practice by males of urinating into the conventional bathroom toilet bowl from a standing position results in unavoidable splashing of liquid from the toilet bowl and the consequent soiling of the floor and wall area around the toilet bowl. Since the liquid splashed from the toilet bowl includes urine, an odor from the soiled area soon becomes objectionable. The amount of liquid splashed from the toilet bowl is a function of the height from which the urine falls into the bowl. If the toilet bowl is used from a sitting position, the problem of splashing liquid from the toilet bowl does not occur. By lowering the distance of fall of liquid into the bowl, there will be less splashing of liquid from the bowl and less soiling of the area around the toilet bowl.

The present invention enables the male user to kneel adjacent to the toilet bowl and thereby to urinate into the toilet bowl from a height slightly above the bowl. The result is that there will be substantially less splashing of liquid from the bowl and less soiling of the surrounding area.

The present invention reduces the chance that the male while urinating will miss the toilet bowl altogether resulting in unsanitary bathroom conditions.

SUMMARY OF THE INVENTION

It is an object of the present invention to provide a kneeling aid which will allow a male to kneel adjacent to and facing a toilet bowl and to urinate into the toilet bowl from a height only slightly above the bowl.

The invention comprises a portable knee rest, or platform, for one knee which is elevated above the floor a distance substantially less than the conventional height of a toilet bowl and an upright standard secured at one side of the platform with a handgrip mounted on top of the standard facilitating kneeling and rising from the platform. It has been found that a platform approximately five inches high and an upright standard approximately twenty-six inches high are suitable for the intended use. The platform is preferably covered with cushioning material on which the knee rests.

BRIEF DESCRIPTION OF THE DRAWING

With the foregoing object and features in view and such other objects and features as may become apparent as this specification proceeds, the invention will be understood from the following description taken in conjunction with the accompanying drawing wherein like characters of reference are used to designate like parts and wherein.

DETAILED DESCRIPTION OF THE DRAWING

Figure 1:
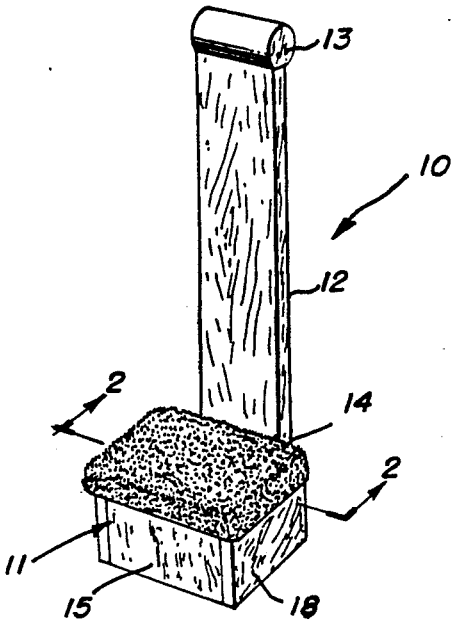
FIG. 1 is a perspective view of the invention.
Figure 2:
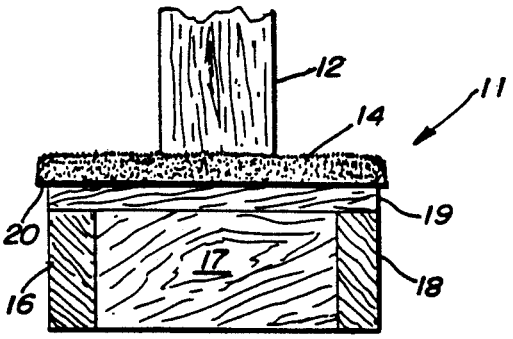
FIG. 2 is a cross-sectional view taken on line 2—2 of FIG. 1.
Figure 3:
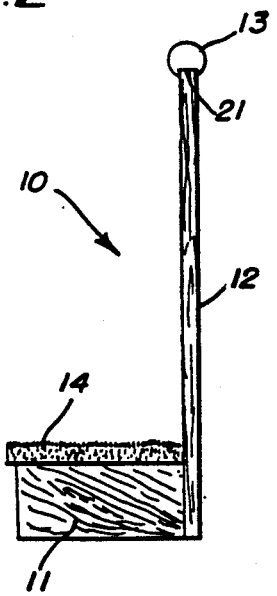
FIG. 3 is a side elevational view of the invention.

Referring to the drawing and particularly to FIGS. 1–3 the kneeling aid device 10 of the present invention comprises a platform 11, an upright standard 12 attached to one side of the platform, a handgrip 13 at the top of the standard and a cushion surface 14 on top of the platform.

The platform 11 is of rigid rectangular box-like construction having four sides 15, 16, 17 and 18 and a top 19 all secured rigidly together. In the embodiment shown, the platform 11 is of wooden construction with a wooden standard 12 and a wooden handgrip 13 attached thereto, however, the platform standard and handgrip may be made of other rigid materials, such as metal, plastic, composition board and the like, which will support the weight of an adult human male. The cushion 14 may be made of a piece of soft carpet which is secured to the top 19 by glue 20 or other suitable means. Other cushioning materials, such as rubber and plastic foams, to name only a few of the available cushioning materials, may be used. The upright standard 12 is an elongated rectangular board nailed, glued or otherwise secured to the back side 17 of the platform 11. The handgrip 13 is a wooden piece which is generally rounded in cross section and provided with a bottom groove 21 which receives the top of the standard 12 and is secured by glueing or other suitable means.

Figure 4:
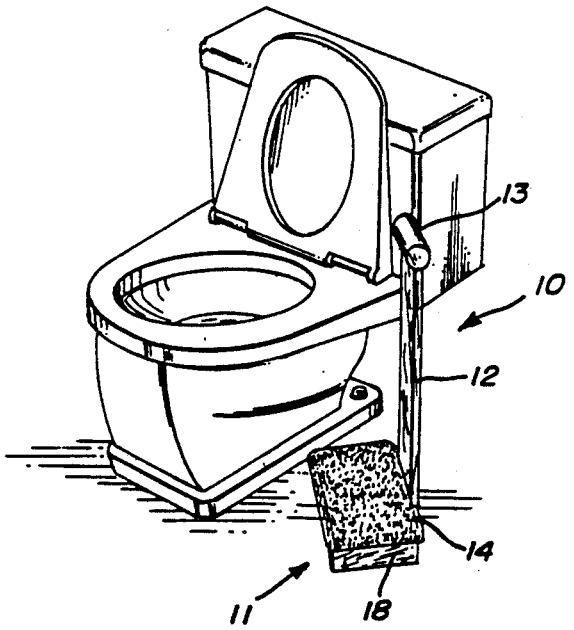
FIG. 4 is a perspective view showing the invention located adjacent to a bathroom toilet bowl in position for use.

FIG. 4 shows the invention in position adjacent to a bathroom toilet bowl for its intended use. When the male needs to urinate, he will approach the toilet bowl in a forward direction, grasp the handgrip 13 with one hand and lower himself to a kneeling position with one knee (the knee on the side of the body adjacent to the handgrip) resting on the platform 12. The male is then in a position to urinate into the toilet bowl from an elevation only slightly above the toilet bowl which will produce little or no splashing of liquid from the bowl. When urination is completed, the male again grasps the handgrip 13 with one hand and lifts himself to a standing position ready to leave the bathroom.

While in the foregoing there has been described and shown a preferred embodiment of the invention, various modifications and equivalents may be resorted to within the spirit and scope of the invention as claimed.

What is claimed is:

1. A method of utilizing a conventional water closet toilet bowl to permit sanitary usage thereof as a male urinal without modification of the bowl or its plumbing attachments and with minimal spillage of urine on the floor area adjacent to the water closet toilet bowl with the assistance of a kneeling aid, said toilet bowl being of the flush-bowl type and having an upper rim upon which a seat and cover are normally pivotally mounted, said kneeling aid including a single knee support elevated to a convenient height between the floor and the rim of the toilet bowl and an upright standard extending above the single knee support and from one side thereof with a hand grip at the top of the upright standard, said method comprising the steps preformed by a male of positioning the kneeling aid on the floor adjacent to and to one side of the toilet bowl with the knee support between the toilet bowl and the upright standard, facing the toilet bowl, grasping the hand grip on the top of the standard with one hand and lowering himself to one knee on his side adjacent to the hand grasping the hand grip until the knee rests on the single knee support, urinating into the toilet bowl from a kneeling position slightly above the rim of the toilet bowl, and upon completion of voiding the bladder rising from the kneeling position to a standing position with the aid of the hand grip on top of the standard.

* * * * *